United States Patent [19]

Balland

[11] 4,072,464

[45] Feb. 7, 1978

[54] EPOXYPROPYL AMMONIUM SALT AND BORIC ACID ASSISTED DYEING PROCESS

[75] Inventor: Jean Balland, Chateaurenault, France

[73] Assignee: Manufacture de Produits Chimiques Protex, Paris, France

[21] Appl. No.: 662,913

[22] Filed: Mar. 1, 1976

[30] Foreign Application Priority Data

Mar. 4, 1975 France ..... 75 07325

[51] Int. Cl.[2] ..... D06P 1/68

[52] U.S. Cl. ..... 8/84; 8/1 A; 8/21 C; 8/100 R; 8/172 R

[58] Field of Search ..... 8/31, 84, 172, 21 C, 8/100

[56] References Cited

U.S. PATENT DOCUMENTS

| | | | |
|---|---|---|---|
| 2,131,146 | 9/1938 | Schlack | 8/177 |
| 3,853,460 | 12/1974 | Balland | 8/84 |

OTHER PUBLICATIONS

Hough, J. International Soc. Leather Trades Chemists, May 1949, pp. 164–176.

*Primary Examiner*—Donald Levy
*Attorney, Agent, or Firm*—Karl F. Ross

[57] ABSTRACT

A process for the dyeing or printing of textile materials wherein, to improve the color rendition or the ability of the textile material to absorb the dye, the textile material is treated with a propylepoxyammonium salt having the formula

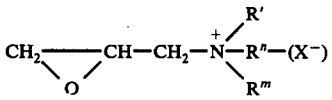

in which R′, $R^n$ and $R^m$ are alkyl radicals, preferably lower alkyl containing 1 to 3 carbon atoms and $X^-$ is an anionic group selected from the sulfate, sulfonate, phosphate or halogenide (fluoride, chloride, bromide or iodide). The fabric is subjected to an elevated temperature (thermal treatment). To prevent yellowing of the textile material the latter is also treated with boric acid.

6 Claims, No Drawings

EPOXYPROPYL AMMONIUM SALT AND BORIC ACID ASSISTED DYEING PROCESS

FIELD OF THE INVENTION

The present invention relates to improvements in the dyeing or coloration of textile materials and, more particularly, to improvements in the dyeing or printing of textile materials in which additives are used to promote the pickup of the dyestuff from the solution and the degree to which the dyestuff is affixed to the fabric.

BACKGROUND OF THE INVENTION

In the dyeing of textile materials and/or the printing thereof, it has been recognized that it is necessary to utilize various reactive compounds of an electropositive character to improve the fixing of the dyestuff on the fabric. Dyestuffs are employed of different characteristics for different textile materials and, in general, some fabrics are less susceptible to dyeing with certain dyestuffs. Consequently it has been recognized that there are certain additives which can be used to treat the fabric beforehand and/or simultaneously with the dyestuff to improve dye takeup and the fixing of the dyestuff to the fabric.

In French patent No. 7,203,385 of Jan. 26, 1972, there is described the use of propyl epoxy ammonium compounds having the following formula:

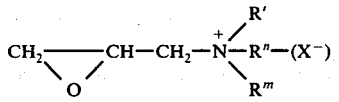

in the dyeing or printing of textile materials. In this formula, R', $R^n$ and $R^m$ are lower alkyl radicals having preferably 1 to 3 carbon atoms while X— is an anionic group such as the sulfate group, the sulfonate group or a halogenide group. The halogenides which may be used are the fluoride, chloride, bromide or iodide.

The additive may be utilized in two distinct processes:

On the one hand it is possible to employ the additive by treating the fibrous support therewith prior to dyeing. The dyeing may then be carried out by using conventional processes and the usual dyestuffs. On the other hand, the product may be applied to the textile material within the dyeing bath or the printing pastes, i.e. in the presence of the dyestuff which is to be taken up by the textile material. This latter approach is the primary subject of the above-identified publication.

In general, the additive must be fixed on the fabric, e.g. a cellulosic textile support, under conditions which may not always be advantageous. For example, it is known to fix the additive to cellulosic materials in the presence of an alkaline substance whose concentration increases inversely with the treatment temperature. In other words higher concentrations of the alkali are necessary with lower temperatures and higher temperatures are required when lower concentrations of the alkali are used.

Generally the alkali is a strong base, preferably caustic soda and extremely high concentrations must be applied to ensure fixation at low temperatures. At higher temperatures of about 100° C or more, a weaker base such as sodium carbonate can be used. Indeed, the weaker base is generally preferred so that the operation in most instances is carried out at elevated temperatures.

More recently it has been found that especially with composite textile supports, i.e. textile supports containing mixtures of fibers of different character, e.g. a mixture of polyester fibers and cellulosic fibers, they can have the additive affixed thereto, in the case of propylepoxyammonium salts, without an alkali additive under conditions in which the treatment is effected at very high temperatures on the order of 170°-230° C. However, such thermal treatments are of the order of those used to ensure dimensional stability of certain textile fibers, especially the synthetics, and thus the treatment is compatible in that it provides, in addition, the fixation of additives which promote improved penetration, fixation of color and color depth upon dyeing with certain dyestuffs.

In general, therefore, one can say that treatments at elevated temperatures have become preferable to the lower-temperature treatments utilized in the prior art.

It has been found that it is possible to treat, for example, fibers of polyester and cellulosic fibers, in an article such as a fabric or in a yarn adapted to form the fabric, with the epoxypropylammonium salt in the absence of the dyestuff and in the course of the forming or dimensional-stabilization treatment. This technique has the advantage that it does not introduce an additional operation in the fabric handling process. The dyeing of the two fibers is then carried out conventionally with the usual techniques.

It is also possible to introduce cationic compounds into the dyestuff baths which are plastosoluble and provided to dye the polyester fibers. The compositions are then used to impregnate the fiber and the impregnation step is followed by drying and thermofixing at high temperatures of the textile article. This permits simultaneous dyeing of the polyester part and fixing of the epoxypropylammonium salt upon the cellulosic part. The latter is then dyed in a second operation using conventional techniques and dyestuffs.

In a third approach, the cationic product is introduced into the dyestuff bath containing both the dyestuff intended for the polyester fiber and that intended for the cellulosic fiber. The fixation of both dyestuffs is ensured in a single operation by the thermofixing step.

It has been found that the use of the epoxypropylammonium salt with one or another of these three techniques permits improvement in the dyeing of the cellulosic part of the textile material in a number of ways.

These advantages can be summarized as follows:

A very significant improvement in the dye rendition.

A significant improvement in the quality number especially with direct dyes.

An increase in the number of direct dyes which can be used especially with direct fixation by the thermal treatment.

However, paralleling these improvements it has been found that treatment of the textile material at high temperature, after it has been impregnated with the epoxypropylammonium salt, gives rise invariably to a strong yellowing thereof. The yellowing is not removed in the course of the usual treatments.

Such yellowing constitutes a considerable handicap to the use of the epoxypropylammonium salts at high temperatures.

The yellowing modifies or dulls the color which is desired and makes it impossible to obtain a white background in the printing of fabrics.

OBJECT OF THE INVENTION

It is principal object of the present invention to provide an improved process for the dyeing of fabric utilizing an additive such as the epoxypropylammonium salts described above with treatment at high temperature, especially with textile fabrics having mixed fibers including cellulosic fibers, without the disadvantages enumerated.

DESCRIPTION OF THE INVENTION

Applicant has found that this object can be attained by the treatment of the textile material with boric acid. Most surprisingly, the boric acid treatment completely eliminates the tendency of the fiber to yellow under the influence of the elevated temperature and even improves the fixation of the epoxypropylammonium salt to the fiber.

This is indeed a surprising phenomenon since in general the presence of acids or acid precursors tends to counteract the fixing of epoxyammonium salts of the character described to the textile fiber. It should be borne in mind, in this connection, that it has been found heretofore that basic conditions promote fixing of certain salts to the textile fibers.

Thus the invention resides in a process for the treatment of textile materials to improve the dyeing or printing thereof which comprises fixing on a textile support an epoxypropylammonium salt of the formula:

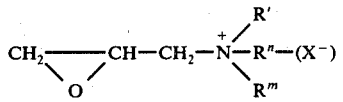

in which R′, R″, R‴ are lower alkyl radicals preferably with 1–3 carbon atoms, and X− is an anionic group selected from the group which consists of sulfate, sulfonate, phasphate or halogenide (the latter being fluoride, chloride, bromide or iodide), the fixation of this compound on the support being effected by a thermal treatment. The present improvement resides in treating the textile support with boric acid to eliminate completely the yellowing of the fibers of the support and, in addition, all detrimental activity of urea at the elevated temperature.

The boric acid appears to be effective with all processes for fixation of the epoxypropylammonium salt at elevated temperatures and is effective on all articles impregnated with these salts to be subjected to a thermofixation operation.

Applicant has observed that the presence of urea, frequently necessary in the dyeing process, tends to reduce the degree to which the epoxypropylammonium salt is fixed to the fiber of the textile material and that the boric acid treatment tends to eliminate this detrimental effect of the urea and gives, on the contrary, an improvement in the dye rendition even in the presence of urea.

It should be noted further that the use of boric acid eliminates to a large measure the evolution of fish-like odors which are produced at elevated temperatures at high intensity during the fixation of epoxypropylammonium salts. Such fish-like odors are particularly noticeable when the thermofixation is carried out in an alkaline medium.

The use of boric acid according to the present invention thus has the following advantages:

Firstly, it eliminates yellowing of the fibers.

Secondly, it eliminates the reduction in the fixation of the product which is brought about by urea and thus improves the degree to which the epoxypropylammonium salt is fixed to the fibers.

Thirdly, it suppresses the negative effects of the urea at high temperature.

Fourthly, it eliminates the possibility that odors will be generated during the process.

SPECIFIC EXAMPLES

EXAMPLE I

Cotton fabric is impregnated in a bath containing 40 g/l of epoxypropyltrimethylammonium chloride (CEPTA) in the presence of 10 g/l of boric acid ($H_3BO_3$). The quantity of the boric acid can be varied in dependence upon the amount of CEPTA used. Upon drying, the fabric is heated for one minute to a temperature of 200° C. There is no yellowing of the cellulosic fiber after this thermal treatment.

A test is carried out using the same technique but in the absence of boric acid and yellowing is observed. Within the period of one minute, the fiber has a strong brownish color.

EXAMPLE II

Cotton fabric is impregnated as described in Example I in a bath containing 40 g/l of CEPTA and 8 g/l of caustic soda (NaOH) and the CEPTA is fixed on the fabric by storing it for 10 hours at a temperature of 26° C in the impregnated state.

After rinsing and drying at a temperature of about 100° C, the fabric shows no yellow. However, after a heat treatment at a temperature of 200° C for 1 minute, the specimen shows a strong yellowing.

If the bath contains 5–10 g of boric acid, the fabric shows no yellowing even after treatment at a temperature of 200° C.

EXAMPLE III

A cotton fabric is treated under conditions identical to those in Example I in the absence of boric acid. After thermal fixation a sample is dyed in a bath containing 2 g/l of Direct Blue 78 C.I. 34200 dye. Another sample is treated identically except that the boric-acid-containing bath of Example I was used.

After dyeing, the color intensity of the specimen in which boric acid was used is considerably greater and more brilliant than that of the specimen dyed without the boric acid treatment.

EXAMPLE IV

A polyester/cotton fabric having a polyester/cotton ratio of 66/33% is treated in a bath having the following composition:

20 g/l of Red Disperse 74 dye
40 g/l of CEPTA
10 g/l of boric acid.

After impregnation and drying, a thermofixation is carried out at 220° C for 45 seconds. The following results are obtained:

A specimen dyed with the above bath shows no yellowing of the cellulosic part.

There is no dulling of the red color of the polyester part.

The fabric is then subjected to an aftertreatment in which the cellulosic part is dyed by a conventional technique. Full coloring as described in the French patent mentioned above is obtained.

Both parts of the fabric have full vivacity of color.

EXAMPLE V

The fabric treated in Example IV is used with a bath of the following composition:

20 g/l of Red Disperse 74 dye;
20 g/l of Red Direct 81 CI 28160 dye;
40 g/l of CEPTA;
100 g/l of urea;
10 g/l of boric acid.

After impregnation and drying, a thermofixation step is carried out for 45 seconds at 220° C. The results are as follows: The coloristic rendition is significant on both fibers; the brightness of color is excellent in both fibers; the solidity level of the direct dye is excellent.

A comparative test was made using the above composition but omitting the CEPTA. There is no noticeable fixation of the direct color.

Another sample was treated using the above bath but in the absence of boric acid. There was a noticeable reduction of the coloristic intensity of the cellulosic fibers with dulling of the polyester coloration.

In general it was found that best results are obtained with a concentration of boric acid between 1 and 25 g/l and a concentration of the epoxpropyltrialkyl ammonium salt of about 4 g/l to 100 g/l. The ratio between the epoxypropyltrialkyl ammonium salt and the boric acid by weight should be between 2:1 and 10:1.

Preferably, the elevated-temperature thermal treatment is carried out at a temperature of the order of 150°–230° C and the fixation of the epoxypropylammonium salt is effected at a pH which is slightly acid.

I claim:

1. In a process for the treatment of textile material to improve the dyeing or printing thereof, the improvement which comprises the steps of:

a. applying to said textile material an epoxypropylammonium salt having the formula:

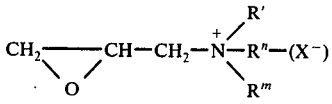

in which R', $R^n$, $R^M$ are lower alkyl radicals and X− is an anion selected from the group which consists of sulfate, sulfonate, phosphate and halogenide;

b. fixing the salt upon the textile material at least in part at an elevated temperature; and c. treating the textile material prior to the application of said elevated temperature thereto with boric acid in an amount sufficient to avoid all yellowing of the fibers of said material and to prevent any detrimental action of urea at the elevated temperature.

2. The improvement defined in claim 1 wherein said alkyl radicals have 1 to 3 carbon atoms.

3. The improvement defined in claim 2 wherein the boric acid is applied to the textile material before fixation of said salt on the fibers of said material by thermal treatment.

4. The improvement in claim 2 wherein the boric acid is applied to said material after fixation of the salt on said fibers by a thermal treatment which is followed by said treatment at elevated temperature.

5. The improvement defined in claim 2 wherein the textile material is treated with a bath containing said salt and boric acid, said textile material thereafter being subjected to drying and said thermal treatment, the latter being carried out at a temperature of the order of 150° to 230° C.

6. The improvement defined in claim 2 wherein the fixation of said salt on said textile material is carried out at a pH which is slightly acid.

* * * * *